US005138229A

United States Patent [19]

Honda et al.

[11] Patent Number: 5,138,229

[45] Date of Patent: Aug. 11, 1992

[54] SINGLE-SEALED METAL VAPOR ELECTRIC DISCHARGE LAMP

[75] Inventors: Kazuo Honda, Hiratsuka; Atsushi Matsuura, Yokohama; Hisanori Sano, Yokosuka, all of Japan

[73] Assignee: Toshiba Lighting & Technology Corporation, Tokyo, Japan

[21] Appl. No.: 584,078

[22] Filed: Sep. 18, 1990

[30] Foreign Application Priority Data

Sep. 20, 1989 [JP] Japan ..... 1-244591
Dec. 28, 1989 [JP] Japan ..... 1-343624

[51] Int. Cl.[5] ..... H01J 61/06

[52] U.S. Cl. ..... 313/628; 313/631; 313/632

[58] Field of Search ..... 313/628, 631, 632

[56] References Cited

U.S. PATENT DOCUMENTS 4,766,348 8/1988 English et al. ..... 313/631
4,782,266 11/1988 Heider et al. ..... 313/631
4,864,191 9/1989 van de Weijer et al. ..... 313/631 X
4,973,880 11/1990 Honda et al. ..... 313/633
4,988,917 1/1991 Cox ..... 313/631

FOREIGN PATENT DOCUMENTS 0250920 1/1988 European Pat. Off. .
0343625 11/1989 European Pat. Off. .
2620857 3/1989 France .
2126415 3/1984 United Kingdom .

*Primary Examiner*—Palmer C. DeMeo
*Attorney, Agent, or Firm*—Cushman, Darby & Cushman

[57] ABSTRACT

A single-sealed metal-vapor discharge lamp forms a press sealed portion on one end to seal in a discharge space starting noble gas, light emission metal, and mercury. The discharge lamp has a pair of electrodes with bent portions whose tip ends are bent opposite to each other in the discharge space; a pair of inner metallic foil conductors, to each one end of which the proximal ends of the electrodes are joined; and an arc tube enclosing a pair of internal lead wires, each one end of which is joined to the other end of the inner metallic foil conductors. The electrodes which are arranged approximately parallel in the arc tube. A bend angle $\theta$ of the bent portions arc is $60° \leqq \theta \leqq 120°$, and the curvature radius R of the periphery of the bent portions is approximately $R \geqq 1.2d$ (where, d is wire diameter of the electrode rod).

21 Claims, 5 Drawing Sheets

SINGLE-SEALED METAL VAPOR ELECTRIC DISCHARGE LAMP

BACKGROUND OF THE INVENTION

1. Field of the Invention

The present invention relates to single-sealed metal vapor electric discharge lamps such as small-size metal halide lamps, and more particularly, to single-sealed metal vapor electric discharge lamps with an improved bent portion of the electrode rod.

2. Description of the Related Art

Conventionally, for outdoor lighting and plant lighting, high-intensity discharge lamps (HID), that is, high-pressure metal-vapor electric discharge lamps have been used. Recently, high-pressure metal-vapor electric discharge lamps have been gaining popularity the use of indoor lighting of low shop ceilings.

The popular use of high-pressure metal-vapor electric discharge lamps is attributed to the downsizing of the light emission tube of the discharge lamp, the external lamp tube material quartz, as opposed to hard glass, has higher heat resistance, and the reduced overall lamp size. In addition to this, because the high-pressure metal-vapor discharge lamps can utilize conventional properties of high efficiency, high color rendering, high output, and long life, the use of the high-pressure metal-vapor discharge lamps in place of incandescent lamps and halogen lamps can reduce electric consumption.

In particular, the metal halide lamp provides superiority or high efficiency and high color rendering compared to other discharge lamps. These attributes are especially suitable for lighting of displayed products, and thus their popularity has been rapidly increasing.

However, employing the conventional double-sealed envelope construction for downsizing the light emission tube not only requires time and labor in forming but also increases the sealed portion size, thus increasing the overall size. Moreover, it has a drawback that heat loss from the light emission tube increases through these sealed portions.

For this reason, with this kind of small-size lamps, the compression-sealed portion is formed in the shape of the light emission tube on one side of the envelope only, to which a pair of electrodes are sealed; that is, single-sealed construction is employed.

The single sealed configuration achieves smaller heat loss a compared to the double-sealed form envelope, thereby permitting improvement of light-emission efficiency. In addition, no extra time and labor is required for forming, and the sealed portion that tends to increase the size relatively as compared to the electric discharge space is reduced to only one; reducing the whole lamps size.

The single-sealed lamp of this kind has a pair of electrodes guided to the electric discharge space from one sealed portion. Consequently, a pair of electrode rods tends to be arranged in parallel to each other, increasing the possibility of electrical discharge between electrode rods. That is, electric discharge in the discharge space tends to occur between a pair of electrodes where the distance between electrodes is the shortest and also at the place susceptible to the condition of easy electrical discharge. For this reason, in the single-sealed lamps, electric discharge sometimes occurs at the electrode rods since the difference in electrode-to-electrode distance and electrode coils which are formed at the tip ends of these electrode rod is small.

Such electric discharge at the electrode rods not only accelerates blackening due to scattering of electrode rod material over the arc tube but also breaks the electrode rods early.

To avoid this phenomenon, the electrode rod tip ends are bent closer to each other and the tip ends of these bent portions have electrode coils. This makes the distance between electrode coils shorter than that between electrode rods, allowing the discharge to occur surely between electrode coils and preventing generation of discharge between rods.

However, when the electrode rod tip ends are bent, an excessively small or large bend angle reduces difference between the clearance at the bent portions and the distance between base ends of electrode rods and it becomes difficult to make clear difference between distance between electrode coils and that between electrode rods, cancelling the effect of prevention of discharge between rods.

Too small of a curvature radius of the bent portion causes damage to the bent portion during bending resulting in breakage and lower yields. Furthermore, there is a problem that cracks generated during bending grow in service and cause breakage in the bent portion, eventually dropping electrodes.

SUMMARY OF THE INVENTION

Therefore, the objective of the present invention is to provide a single-sealed metal-vapor electric discharge lamp which can allow discharge between coils to take, place surely as well as preventing breakage of the bent portion during forming and in service.

According to an aspect of the present invention, there is provided a single-sealed metal-vapor discharge lamp comprising a pair of electrode means with a bent portion whose tip ends are bent opposite to each other in a discharge space, a pair of inner metallic foil conductor means, to each one end of which the rear ends of the electrode means are joined, a pair of inner wiring members, each one end of which is joined to the other end of the inner metallic foil conductor means, arc tube means which has at its one end an inner press sealed portion for sealing the pair of electrode means, the inner metallic conductor means, and the inner wiring members and starting contains a fill including mercury, halide and gas, wherein the electrode means are arranged nearly in parallel, the bend angle $\theta$ of the bent portion is nearly $60° \leqq \theta \leqq 120°$ and the curvature radius R of the periphery of the bent portion is nearly $R \geqq 1.2\ d$ (where, d is a wire diameter of the electrode means).

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
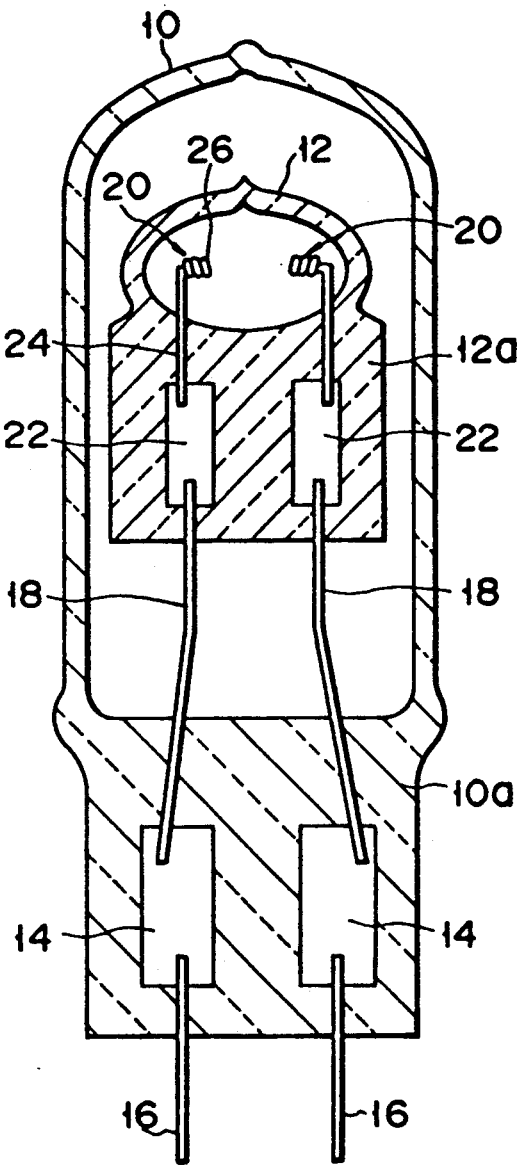
FIG. 1 a cross sectional view of a small halide lamp showing the first embodiment according to the present invention.

Referring now to the drawings, embodiments of a halide lamp according to the present invention will be described in detail hereinafter.

FIG. 1 shows, for example a metal halide lamp with lamp input power of 150 W, in which the outer envelope 10 comprising quartz glass encloses an arc tube 12. The outer envelope 10 forms a press sealed portion 10*a* on its one end only, to which a pair of metallic foil conductors 14 including molybdenum (Mo) are sealed. To these metallic foil conductors 14, the external lead wires 16 are connected respectively and the internal lead wires 18 which serve as a support are also connected respectively. In general, to the press sealed portion 10*a* of the outer envelope 10, a base (not shown) is mounted.

The arc tube 12 forms the same single seal type as the outer envelope 10 and comprises quartz glass, etc. The arc tube 12 has a nearly elliptically-shaped discharge space, for example, with the inner volume of 0.5 cc. The elliptic-shape discharge space has the major-axis direction designated as the envelope axis, and at one end of the minor-axis- direction intersecting the envelope axis at right angles, a press sealed portion 12*a* is formed.

In the arc tube 12, a pair of electrodes 20 are arranged opposite to each other with some clearance inbetween in the envelope-axis direction. These electrodes 20 are connected to a pair of metallic foil conductors 22 such as Mo, respectively, which are sealed to one side of the press sealed portion 12*a*. The inner lead wires 18 which serve also as the support of the outer envelope 10 are connected to the metallic foil conductor 22, respectively.

The pair of electrodes 20 have the electrode rod 24 and the electrode coil 26 pressed-fit and wound to the electrode rod 24. The electrode rod 24 is formed with either pure rhenium or rhenium-tungsten alloy wire whose diameter d is 0.5 mm or tungsten wire plated with pure rhenium or rhenium-tungsten alloy. The electrode rods 24 have the base ends connected to the metallic foil conductors 22 of the press sealed portion 12*a*, while the tip ends are bent to form the bent tip end portion 24*a* so that electrodes 20 face each other.

In this event, the base ends of the electrode rods 24 extend nearly vertical to the press sealed portion 12*a*. The bent tip end portions 24*a* formed at the tip end of the electrode rods 24 are bent at an angle $\theta$ against the base ends. The bend angle $\theta$ is restricted nearly to $90° \pm 30°$ ($60° \leqq \theta \leqq 120°$), and in the embodiment the portion is bent nearly at $\theta = 90°$.

The curvature radius R of the periphery of the portion bent nearly at 90° is nearly $R \geqq 1.2$ d against the wire diameter d of the electrode rods 24. In the embodiment, $R = 1.2$ d $= 0.6$ mm.

The electrode coil portions 26 are formed by winding 0.5 mm diameter tungsten or triated tungsten (about 2% of $ThO_2$ contained) wire in coil form with, for example, three to four wraps. The electrode coil portions 26 are wound around and fixed to the bent tip ends 24*a* of the electrode rods 24.

In the embodiment, the coil wire diameter d is 0.5 mm and the axial dimensions between electrode coil portions 26 facing each other, that is, electrode-to-electrode distance is set to about 6.8 mm.

In the outer envelope 10, starting novel gas, a specified volume of metal halides such as mercury, tin iodide ($SnI_2$), sodium iodide (NaI), thallium iodide (TlI), indium iodide (InI), sodium bromide (NaBr), lithium bromide (LiBr), and so forth are enclosed. In addition, this kind of single-sealed metal halide lamp is designed to be lit at high lamp loads to increase light emitting efficiency, and is lit at loads as high as about 20–70 in terms of WL/S; where WL (Watt) denotes the input power and S ($cm^2$) the inner surface area of the arc tube.

In the embodiment, to lamp power W is set the 150 W when the lamp current I is 1.8 A during stable lighting. The inner surface area S of the arc tube is 3.5 $cm^2$ and the lamp load per unit surface are of the arc tube is about 43 $W/cm^2$.

The operation of the small metal halide lamp configured as above is described as follows.

The electrode rod 24, of each electrode 20 has its tip end bent and the bent tip end portion 24*a* of the electrode rod 24 is arranged so that the tip ends come near to each other.

Consequently, the distance between electrode coils 26 installed to the tip ends of these tip end bent portions 24*a* becomes shorter than any other portion of two electrodes 20, allowing electric discharge to take place surely at the electrode coil portions 26.

In the present invention, the bend angle $\theta$ of the bend tip end portion 24*a* with respect to the base end of the electrode rod 24 is restricted to $90° \pm 30°$ ($60° \leqq \theta \leqq 120°$) and in this embodiment it is formed nearly to $\theta = 90°$. Therefore, the tip end position of the electrode coil portion 26 can be extruded greatly with respect to the base end of the electrode rod 24.

As a result, electric discharge can be generated surely between electrode coils 26 and electric discharge at the electrode rod 24 can be prevented, eliminating breakage of the electrode rod 24.

The curvature radius R of the periphery of the bent portion is set to $R \geqq 1.2$ d with respect to the wire diameter d of the electrode rod 24, and in the embodiment, $R = 1.2$ d $= 0.6$ mm.

Consequently, the curvature radius R becomes large, preventing breakage and bending crack during forming. This also prevents breakage and dropping of the bent portion in service.

The single-sealed metal halide lamp as described above is lighted at high lamp load in order to increase light emission efficiency. For example, it is lighted at a WL/S value as high as 20–70 where WL (watt) denotes the input power and S ($cm^2$) the inner surface area of the light emission tube, and in this embodiment, the lamp is lighted at about 43 $W/cm^2$.

Nevertheless, in the embodiment, the electrode rod 24 is formed with pure rhenium or rhenium-tungsten alloy wire. Or the electrode rod 24 is also formed with tungsten wire coated with pure rhenium or rhenium-tungsten alloy. The electrode rod 2 formed in this way increases halogen resistance, restricts temperature rise of the electrode rod 24 during lighting, and prevents breakage due to loss of weight at the electrode rod 24.

The electrode rod 24 described above has a low melting point, providing good joint efficiency in joining the sealed end 12*a* to the metallic foil 22, and welding becomes easy.

In contrast, the electrode coil section 26 mounted to the tip end of the electrode rod 24 is formed with either tungsten or triated tungsten. Consequently, it has good electron emissiblity and high melting point, thus providing less chance to scatter electrode materials and reducing blackening of the tube wall.

Since the bent tip end 24*a* of the electrode rod 24 is indented from the discharge space side as compared to the tip end of the electrode coil section 26, arc spot generation is prevented at the tip end of the electrode rod 24 formed with the low melting point. This prevents scattering of the electrode rod 24, thus preventing lowering of the lumen maintenance factor based on blackening of the envelope wall.

Figure 3:
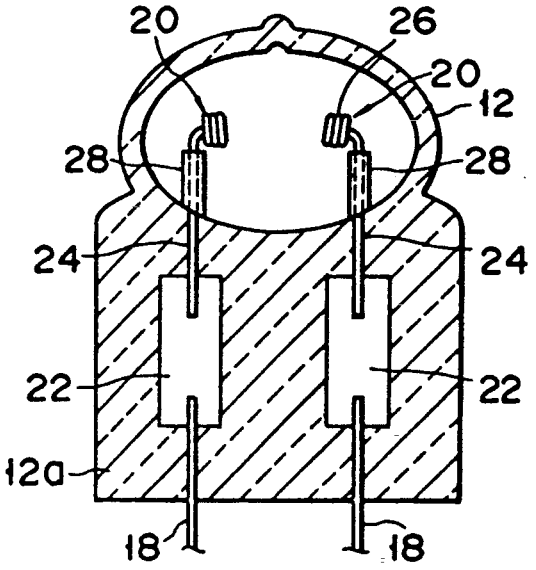
FIG. 3 is a cross sectional view of a small halide lamp showing the second embodiment according to the present invention.

FIG. 3 is cross-sectional view of the small metal halide lamp showing the second embodiment of the present invention.

Figure 2:
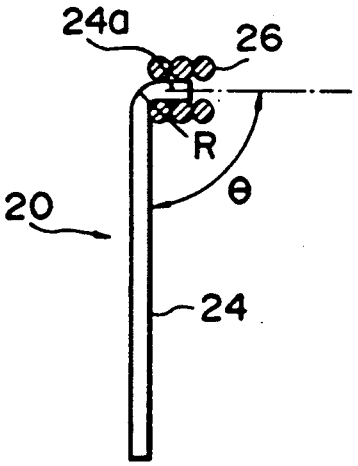
FIG. 2 is a cross sectional view showing the electrode construction of the lamp of FIG. 1.

In the drawings, the portion same as FIG. 1 and FIG. 2 are given the same reference numbers and definition is omitted. In FIG. 3, the outer envelope 10, press sealed portion 10*a*, metallic foil conductor 14, and external lead wire 16 are not shown.

In FIG. 3, the pair of electrodes 20 have their base portion connected to the metallic foil conductor 22 of the compression-sealed portion 12*a* and includes the electrode rod 24, whose tip ends form the bent tip end portion 24*a* and are bent to allow each electrode 20 to face each other, and the electrode coil portion 26 press-fitted and wound to the electrode rod 24. The electrode rod 24 is formed either with pure rhenium or rhenium-tungsten alloy wire of diameter d of 0.5 mm or with tungsten wire coated with pure rhenium or rhenium-tungsten alloy. The electrode rods 24, insulation sleeves 28, for example, made from quartz glass, alumina, and so forth, are covered, respectively.

The configuration in which the electrode rod 24 is covered with the insulation sleeve 28 in this way prevents generation of arc spot at the tip end of the electrode rod 24 formed with the material of low melting point as well as preventing successfully scattering between electrode rods 24 with the insulation sleeve 28, further preventing lowering of the lumen maintenance factor based on blackening of the envelope wall.

The present invention shall not be limited by any of the details of the metal halide lamp described in the aforementioned embodiments. That is, the present invention is applicable to any discharge lamps in which press sealed portion is formed only at one end of the envelope, and therefore, the present invention can be any other small metal-vapor discharge lamps such as high-pressure mercury-vapor lamps.

Now, in the single-sealed arc tube configured in the first and second embodiment, the electrode rods and the external lead wires which are conducted through the electrode rods are welded to the same side of the metallic foil conductor. The single-sealed small metal halide lamp as described above is designed to be lighted at increased lamp load for increased light emission efficiency. This not only raises temperature of the light emission tube but also increases vapor pressure in the discharge space. The substance packed in the discharge space, such as packed metal halide, leaks at the clearance between glasses at the seals, when pressure is increased.

At the press sealed portion, air-tightness of the discharge space is held by the electrode rods, metallic foil conductors, and external lead wires bonded to the glass at the seals. However, as the temperature at the seals rises during lighting the gas pressure of the metal halide in the discharge space increases to over 20 atmospheric pressure. This high-pressure gas intrudes into the bonded surface between electrode rods and glass at the seals, spoiling adhesion of the bonded surface between electrode rods and glass at the seals and generating a leak clearance. The leak clearance gradually develops to the bonded surface between metallic foil conductor and glass at the seals, and further progresses to the bonded surface between external lead wire and glass at the seals, and eventually generates a leak clearance conducting the discharge space to the outside between the electrode rods, metallic foil conductor, and external lead wire and glass at the seals, thereby leaking metallic halide in the discharge space to the outside, though the phenomenon is observed only rarely.

In such event if the electrode rods and external lead wires are joined to the same surface of the metallic foil conductors, respectively, the leak clearances formed respectively between the electrode rods, metallic foil conductors, and external lead wires and glass at the seals are shifted on the same surface side, generating the leak clearance conducting the discharge space to the outside at the shortest distance. Consequently the time to generate the leak is shortened, thus shortening the lamp life.

Figure 4:
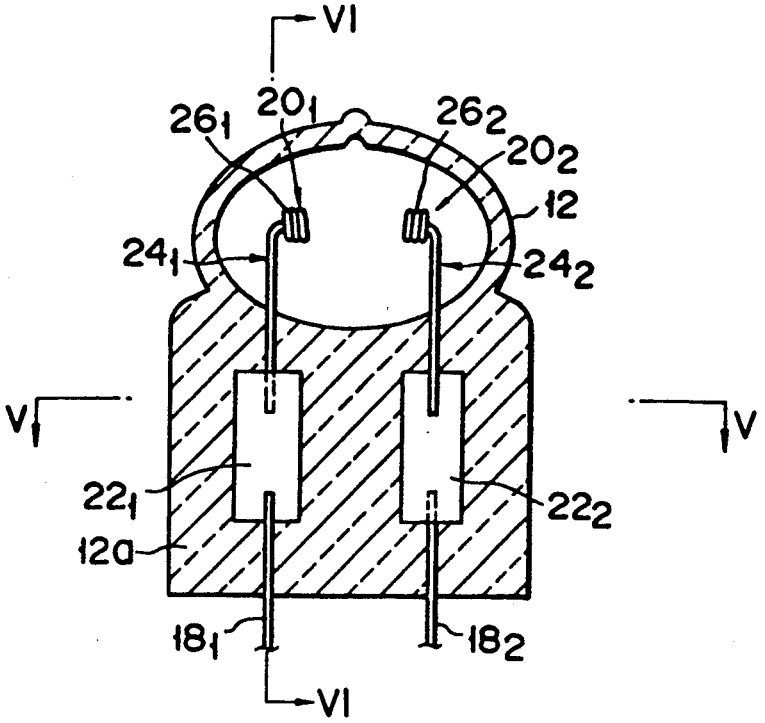
FIG. 4 is a cross sectional view of a small halide lamp showing the third embodiment according to the present invention.
Figure 5:
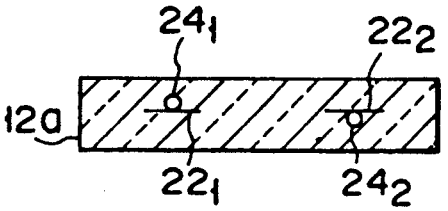
FIG. 5 is a cross sectional view of line V—V in FIG. 4.
Figure 6:
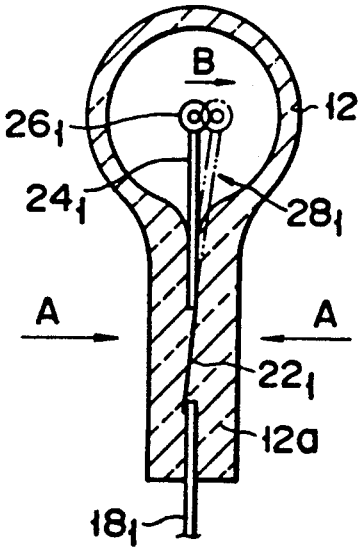
FIG. 6 sectional view of line VI—VI in FIG. 4.
Figure 7:
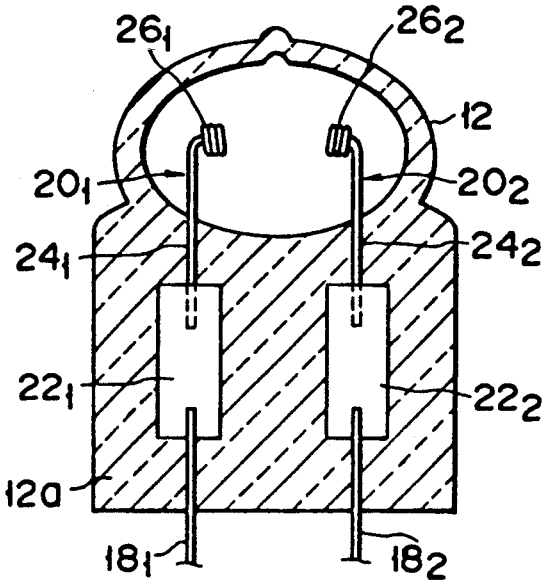
FIG. 7 is a cross sectional view of a small halide lamp showing the fourth embodiment according to the present invention.

FIGS. 4 through 9 show small metal halide lamps of other embodiments according to the present invention with improved lamp life. In the embodiments described below, the portions same as embodiments already described are given the same reference numbers and definition is omitted. In FIGS. 4 and 7, the outer envelope 10, compression-sealed portion 10*a*, metallic foil conductor 14, and outside lead wire 16 are not shown.

FIGS. 4 through 6 show the third embodiment according to the present invention, in which the quartz glass arc tube 12 of the metal halide lamp of the lamp input 150 W is formed in an elliptical sphere 0.5 cc in the inside volume. In the arc tube 12, a pair of electrodes $\mathbf{20_1}$, $\mathbf{20_2}$ are arranged facing each other with some clearance in the envelope axis direction and are sealed to the press sealed portion 12*a*, respectively. The electrodes $\mathbf{20_1}$, $\mathbf{20_2}$ comprises electrodes rods $\mathbf{24_1}$, $\mathbf{24_2}$ and electrode coil portion $\mathbf{26_1}$, $\mathbf{26_2}$. The electrode rods $\mathbf{24_1}$, $\mathbf{24_2}$ include, for example, 0.5 mm-diameter pure rhenium wire, while the electrode coil portions $\mathbf{26_1}$, $\mathbf{26_2}$ are formed by wrapping several turns of, for example, 0.5 mm-diameter triated tungsten wire around the bent tip ends of the electrode rods $\mathbf{24_1}$, $\mathbf{24_2}$. The electrode coil portions $\mathbf{26_1}$, $\mathbf{26_2}$ facing each other have about 6-mm clearance provided along the envelope axis direction.

The electrode rods $24_1$, $24_2$ are connected to the metallic foil conductors $22_1$, $22_2$ such as Mo which is sealed to the press sealed portion 12a. In such event, the electrode rods $24_1$, $24_2$ are arranged to form opposite surfaces with respect to the sides of the metallic foil conductors $22_1$, $22_2$, respectively. That is, as seen from the point shown in FIG. 5, one electrode rod $24_1$, is welded to the rear surface of one metallic foil conductors $22_2$ whereas the other electrode rod $24_2$ is welded to the front surface of the other metallic foil conductor $22_2$. The major-axis direction of the metallic foil conductors $22_2$, is about 15 mm and the width about 3 mm, and the connections with the electrode rods $24_1$, $24_2$ are about 1.5–2 mm.

To these metallic foil $22_1$, $22_2$, internal lead wires $18_1$, $18_2$ are connected and guided to the outside from the edge of the press sealed portion 12a. In this event, lead wire $18_1$, $18_2$ is connected to the surface opposite to the electrode rods $24_1$, $24_2$ connected to the metallic foil conductors $22_1$ $22_2$ with respect to the metallic foil conductors $22_1$ $22_2$ to which lead wires are connected. That is, one internal lead wire $18_1$ is welded to the front surface of one metallic foil conductors $22_1$, whereas the other internal lead wire $18_2$ is connected to the rear surface of the other metallic foil conductor $22_1$. Consequently, as seen from one metallic foil conductors $22_1$, the electrode rod $24_2$ and the internal lead wire $18_1$ connected to it are connected on the opposite surfaces, respectively. As seen from one metallic foil conductors $22_2$, the electrode rods $24_2$ and the internal lead wire $18_2$ connected to it are also connected on the opposite surfaces, respectively.

In the arc tube 12, starting noble gas and a specified volume of mercury, $SnI_2$, NaI, TlI, InI, NaBr, LiBr, and other metal halides are packed.

Now, the operation of the lamp configured as above is described hereunder.

In forming the press sealed portion 12a at the tip end of the arc tube 12, the metallic foil conductors $22_1$, $22_2$ previously connected with electrode rods $24_1$, $24_2$ and internal lead wires $18_1$, $18_2$ are inserted to the envelope opening which is not yet closed, and the envelope opening wall is heated with burners to soften. Then, with a pair of pincers not illustrated, the softened envelope wall is compressed in the arrow A direction shown in FIG. 6. This closes the envelope opening and the metallic foil conductors $22_1$, $22_2$ are simultaneously sealed in.

In this event, the metallic foil conductors $22_1$, $22_2$ tightly held by glasses tend to tilt the electrode rods $24_1$ joined to one side of one of the illustrated metallic foil conductors (for example, $22_1$) in the direction shown with an imaginary line (illustrated arrow B direction). In the embodiment, one electrode rods $24_1$ is welded on one surface with respect to one of the metallic foil conductors $22_2$, whereas the other electrode rods $24_2$ is welded to the other surface with respect to the other metallic foil conductors $22_2$. Consequently, these electrode rods $24_1$, $24_2$ tilt oppositely with respect to the are center in the envelope.

Therefore, if the electrode coil portions $26_1$, $26_2$ deviate sidewise from the envelope axis due to the tilting of the electrode rods $24_1$, $24_2$, they are shifted in the direction symmetric with respect to the envelope center, and therefore their centers agree nearly with the envelope center. This stabilizes light emission characteristics and because there is no change for the arc to approach intensively to a certain portion of the envelope wall, the light emission tube 12 is not heated locally, resulting in long life.

In addition, each internal lead wire $18_1$, $18_2$ is connected to the surface opposite to the electrode rods $24_1$, $24_2$ connected to the metallic foil conductors $22_1$, $22_2$ with respect to the metallic foil conductors $22_1$, $22_2$ to which the lead wires are connected, requiring a long time for the gas in the discharge space to leak. That is, one of the electrode rods $24_1$ is welded to the rear surface of one metallic foil conductors $22_1$, whereas the lead wire $18_1$ connected to this is welded to the front surface of the metallic foil conductors $22_1$. One of the electrode rods $24_2$ is welded to the front surface of one metallic foil conductors $22_2$, whereas the lead wire 18 connected to this is welded to the rear surface of the metallic foil conductors $22_2$.

Consequently, in the event any leak occurs, the leak clearances generated on the contact surface between these electrode rods $24_1$, $24_2$, the metallic foil conductors $22_1$, $22_2$, and internal lead wires $18_1$, $18_2$ and glass at the seals, respectively, are generated on the surfaces alternately along the lead wire direction. Consequently, the creepage distance between leak clearances which conduct the discharge space to the outside is increased practically. This increases the time required to generate a gas leak in the discharge space, thus increasing the lamp life.

In particular, in the small single-sealed discharge lamp lit at the load WL/S as high as some 20–70, the gas pressure in the discharge space during lighting exceeds about 20 atmospheric pressure. Even with such high-pressure gas, connecting the electrode rods $24_1$, $24_2$ and internal lead wires $18_1$, $18_2$ to the surfaces opposite to the metallic foil conductors $22_1$, $22_2$ can prevent early generation of leakage, achieving long life.

In the third embodiment, as shown in FIG. 5, one electrode rod $24_1$ is welded to the rear surface of one metallic foil conductors $22_1$ as well as welding the other electric electrode rod $24_2$ to the front surface of the other metallic foil conductor $22_2$ to prevent are deviation, but the present invention shall not be limited by any of the details of this description.

FIG. 7 shows the forth embodiment of the present invention. As seen from the point shown in the drawing, both electrode rods $24_1$, $24_2$ are welded to the rear surface of the metallic foil conductors $22_1$, $22_2$ respectively, whereas the internal lead wires $18_1$, $18_2$ are welded to the front surfaces of the metallic foil conductors $22_1$, $22_2$. Other configuration is the same as the embodiment shown in FIG. 4 and therefore the description is omitted.

Figure 8:
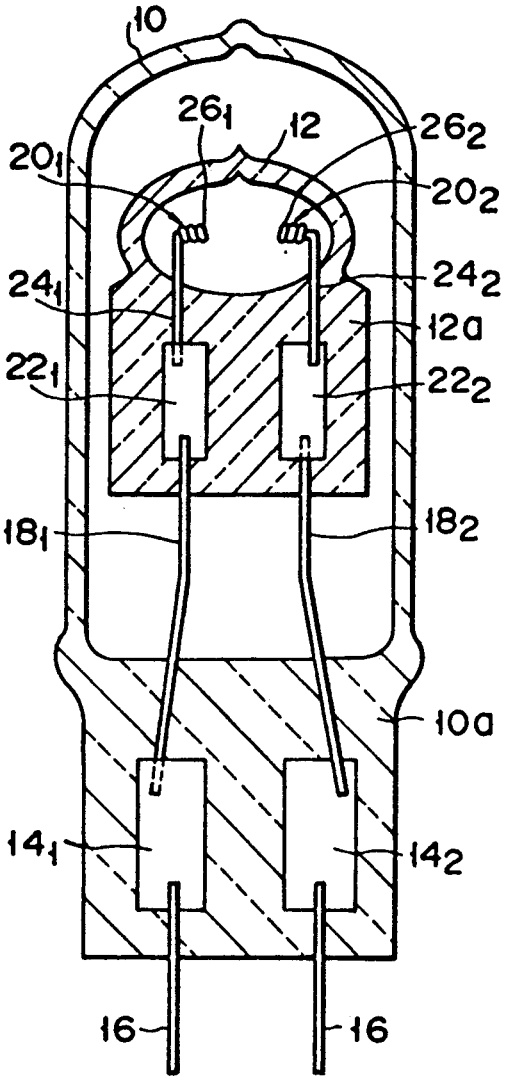
FIG. 8 is a cross sectional view of a small halide lamp showing the fifth embodiment according to the present invention.

FIG. 8 shows the fifth embodiment of the present invention. As seen from the point shown in the drawing, both electrode rods $24_1$, $24_2$ are arranged to form surfaces opposite to the sides of the metallic foil conductors $22_1$, $22_2$, respectively. That is, one electrode rod $24_1$ is welded to the rear surface of the metallic foil conductor $22_1$, whereas the other electrode rod $24_2$ is welded to the front surface of the metallic foil conductors $22_2$.

One end each of the internal lead wires $18_1$, $18_2$ connected to the surface opposite to these electrode rods $24_1$, $24_2$ connected to the metallic foil conductors $22_1$, $22_2$ as against the metallic foil conductors $22_1$, $22_2$ to be connected. That is, one end of the internal lead wires $18_1$ is welded to the front surface of one metallic foil conductor $22_1$, whereas the other end of the internal lead wires $18_1$ is welded to the rear surface of the other metallic foil conductor $22_2$. Therefore, as seen from the metallic foil conductor $22_1$, the electrode rods $24_1$ and lead mire $18_1$ connected to the metallic fail conductor $22_1$ are connected on the surface opposite to each other. As seen from the other metallic foil conductor $22_2$, the electrode rods 24: and lead wire $18_2$ connected to the metallic foil conductor $22_2$ arc connected on the surface opposite to each other.

In addition, each of other end of the internal lead wires $18_1$, $18_2$ are arranged to form a surface opposite to each other with respect to the sides of a pair of metallic foil conductor $14_1$, $14_2$ installed to the press sealed portion 10*a*. That is, the other end of one lead wire $18_1$ is welded to the rear surface of one metallic foil conductor $14_1$, whereas the other end of the other lead wire $18_2$ is welded to the front surface of the other metallic foil conductor $14_2$. Other configuration is same as the embodiments described before and the description is omitted.

Figure 9:
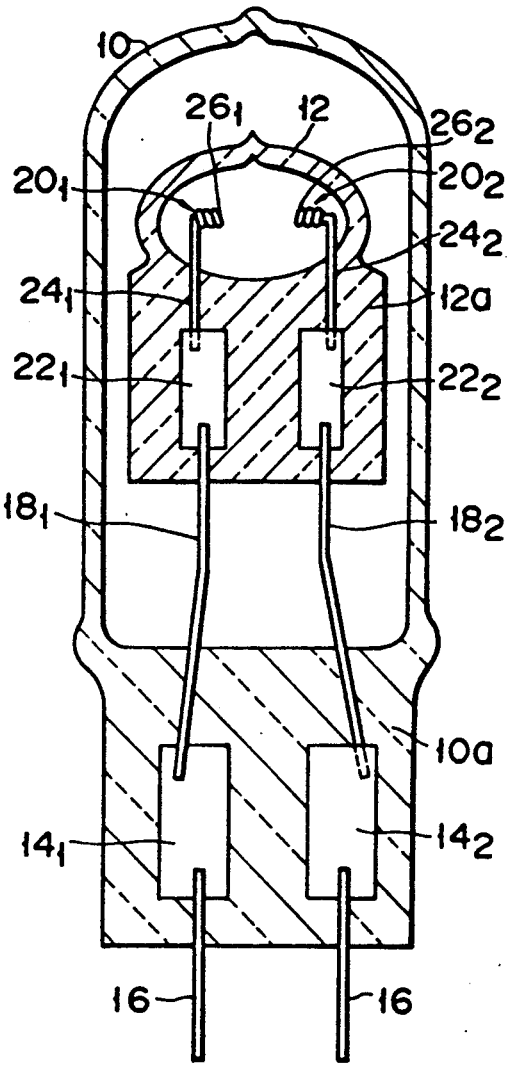
FIG. 9 is a cross sectional view of a small halide lamp showing the sixth embodiment according to the present invention.

FIG. 9 shows the sixth embodiment of the present invention. As seen from the point shown in the drawing, both electrode rods $24_1$, $24_2$ are welded to the rear surfaces of the metallic foil conductors $22_1$ $22_2$, whereas one end of the internal lead wires $18_1$, $18_2$ are welded to the front surfaces of the metallic foil conductors $22_1$, $22_2$.

One end of each internal lead wires $18_1$, $18_2$ is arranged to form a surface opposite to each other with respect to the sides of a pair of metallic foil conductors $14_1$, $14_2$ sealed to the press sealed portion. That is, the other end of one internal lead wire $18_1$ is welded to the front surface of one metallic foil conductor $14_1$, whereas the other end of the internal lead wire $18_1$ is welded to the rear surface of the other metallic foil conductor $14_1$.

In this way, joining the electrode rods and internal lead wires to the surfaces opposite to each other of the metallic foil conductors, respectively can further improve the length of the leak clearance that conducts the discharge space to the outside. Consequently, the time to generate leakage can be extended to increase the lamp life.

Additional advantages and modifications will readily occur to those skilled in the art. Therefore, the invention in its broader aspects is not limited to the specific details, and representative devices, shown and described herein. Accordingly, various modifications may be without departing from the spirit or scope of the general inventive concept as defined by the appended claims and their equivalents.

What is claimed is:

1. A single-sealed metal-vapor discharge lamp comprising:

a pair of electrode means each bent at a bending portion such that tip ends thereof face each other in a discharge space, a distance between the electrode means gradually decreasing toward the tip ends from the bending portions;

a pair of inner metallic foil conductor means having a first and second end, the first end of each metallic foil conductor being connected to a proximal end of a corresponding electrode means;

a pair of inner wiring members each having a first end connected to a corresponding second end of an inner metallic foil conductor means; and arc tube means having at a single end an inner press sealed portion in which the electrode means, the inner metallic conductor means, and the inner wiring members are sealed, the arc tube means containing mercury, a light-emitting metal, and a starting noble gas;

wherein the electrode means are arranged approximately parallel, a bending angle $\theta$ of the bending portions is $60° \leqq \theta \leqq 120°$ and a curvature radius R of a periphery of the bending portions is $R \geqq 1.2$ d (where, d is a wire diameter of the electrode means).

2. A lamp according to claim 1, wherein the discharge lamp is lit at a load of 20–70 WL/S where an inner surface of said arc tube means is denoted as S ($cm^2$) and an input power as WL (watt).

3. A single-sealed metal-vapor discharge lamp comprising:

a pair of electrode means each bent at a bending portion such that tip ends thereof face each other in a discharge space, each electrode means comprises an electrode rod and an electrode coil wrapped around the tip end;

a pair of inner metallic foil conductor means having a first and second end, the first end of each metallic foil conductor being connected to a proximal end of a corresponding electrode means;

a pair of inner wiring members each having a first end connected to a corresponding second end of an inner metallic foil conductor means; and arc tube means having at a single end an inner press sealed portion in which the electrode means, the inner metallic conductor means, and the inner wiring members are sealed, the arc tube means containing mercury, a light-emitting metal, and a starting noble gas;

wherein the electrode means are arranged approximately parallel, a bending angle $\theta$ of the bending portions is $60° \leqq \theta \leqq 120°$ and a curvature radius R of a periphery of the bending portions is $R \geqq 1.2$ d (where, d is a wire diameter of the electrode means).

4. A lamp according to claim 3, wherein the electrode coils are formed of tungsten or triated tungsten.

5. A lamp according to claim 4, wherein the electrode rods are formed of one of rhenium, rhenium-tungsten alloy, tungsten coated with rhenium, and tungsten coated with rhenium-tungsten alloy.

6. A lamp according to claim 5, wherein the electrode rods have an portion not wrapped by an electrode coil covered with an insulation sleeve.

7. A lamp according to claim 6, wherein said insulation sleeve comprises one of quartz glass and alumina.

8. A lamp according to claim 3, wherein the bending portions are bent at an angle that allows the tip ends of the electrode rods to face each other and provides the shortest distance between the electrode rods.

9. A lamp according to claim 3, wherein the electrode rods and inner wiring members are joined to opposite surfaces of the inner metallic foil conductor means.

10. A lamp according to claim 3, further comprising:

external metallic foil conductor means each having a first end joined to a corresponding second end of an inner wiring member external wiring members each having a first end joined to a corresponding second end of an external metallic foil conductor means, and outer envelope means enclosing the arc tube means and having an external press sealed portion on one end in which the inner wiring members, inner metallic foil conductor means, and the external wiring members are sealed.

11. A lamp according to claim 10, wherein the external metallic foil conductors have first and second surfaces, the second end of one inner wiring member being joined to a corresponding external metallic foil conductor on its first surface, and the second end of an other inner wiring member being joined to a corresponding external metallic foil conductor on its second surface.

12. A lamp according to claim 3, wherein the bending portions are bent at an angle that allows the tip ends of the electrode rods to face each other and provides the shortest distance between the electrode rods, and the electrode coils include one of tungsten and triated tungsten.

13. A lamp according to claim 3, wherein the bending portions are bent at an angle that allows the tip ends of the electrode rods to face each other and provides the shortest distance between the electrode rods, and the electrode rods include one of rhenium, rhenium-tungsten alloy, tungsten coated with rhenium, and tungsten coated with rhenium-tungsten alloy.

14. A lamp according to claim 3, wherein the bending portions are bent at an angle that allows the tip ends of the electrode rods to face each other and provides the shortest distance between the electrode rods, and the electrode rods have a portion not wrapped by an electrode coil covered with an insulation sleeve.

15. A lamp according to claim 3, wherein the electrode rods and inner wiring members are joined to opposite surfaces of the inner metallic foil conductor means, and the electrode coils include one of tungsten and triated tungsten.

16. A lamp according to claim 3, wherein the electrode rods and inner wiring members are joined to opposite surfaces of the inner metallic foil conductor means, and the electrode rods include one of rhenium, rhenium-tungsten alloy, tungsten coated with rhenium and tungsten coated with rhenium-tungsten alloy.

17. A lamp according to claim 3, wherein the external metallic foil conductors have first and second surfaces, the second end of one inner wiring member being joined to a corresponding external metallic foil conductor on its first surface, and the second end of an other inner wiring member being joined to a corresponding external metallic foil conductor on its second surface, and the electrode rods have a portion not wrapped by an electrode coil covered with an insulation sleeve.

18. A lamp according to claim 3, further comprising:

external metallic foil conductor means each having a first end joined to a corresponding second end of an inner wiring member;

external wiring members each having a first end joined to a corresponding second end of an external metallic foil conductor means; and outer envelope means enclosing the arc tube means and having an external press sealed portion on one end in which the inner wiring members, inner metallic foil conductor means, and the external wiring members are sealed, wherein the electrode coils include one of tungsten and triated tungsten.

19. A lamp according to claim 3, further comprising:

external metallic foil conductor means each having a first end joined to a corresponding second end of an inner wiring member;

external wiring members each having a first end joined to a corresponding second end of an external metallic foil conductor means; and outer envelope means enclosing the arc tube means and having an external press sealed portion on one end in which the inner wiring members, inner metallic foil conductor means, and the external wiring members are sealed, wherein the electrode rods include one of rhenium rhenium-tungsten alloy, tungsten coated with rhenium and tungsten coated with rhenium-tungsten alloy.

20. A lamp according to claim 2, further comprising:

external metallic foil conductor means each having a first end joined to a corresponding second end of an inner wiring member;

external wiring members each having a first end joined to a corresponding second end of an external metallic foil conductor means; and outer envelope means enclosing the arc tube means and having an external press sealed portion on one end in which the inner wiring member, inner metallic foil conductor means, and the external wiring members are sealed, and wherein the electrode rods have a portion not wrapped by the electrode coils covered with an insulation sleeve.

21. A lamp according to claim 3, wherein the electrode coils wrapped around the tip ends extend beyond the tip ends.

* * * * *